US006621025B2

(12) United States Patent
Yei et al.

(10) Patent No.: US 6,621,025 B2
(45) Date of Patent: Sep. 16, 2003

(54) ROCKER SWITCH WITH LED INDICATORS

(76) Inventors: Hsun-Wan Yei, No. 5, Sub-Lane 54, Lane 247, Da-Chiao First Street, Yuon-Kong City, Tainan Hsieh (TW); Yu-Wen Hwang, No. 23-1, Sin-Tsai, Tsia-Li Tseng, Tainan Hsieh (TW)

( * ) Notice: Subject to any disclaimer, the term of this patent is extended or adjusted under 35 U.S.C. 154(b) by 84 days.

(21) Appl. No.: 09/942,555

(22) Filed: Aug. 31, 2001

(65) Prior Publication Data

US 2003/0045135 A1 Mar. 6, 2003

(51) Int. Cl.[7] ..... H01H 23/04
(52) U.S. Cl. ..... 200/315
(58) Field of Search ..... 200/315

(56) References Cited

U.S. PATENT DOCUMENTS 5,107,082 A * 4/1992 Valenzona ..... 200/315 X
6,013,885 A * 1/2000 Kowalczyk ..... 200/315

* cited by examiner

*Primary Examiner*—Renee Luebke
(74) *Attorney, Agent, or Firm*—Rosenberg, Klein & Lee

(57) ABSTRACT

A switch assembly includes a base with a frame mounted thereto and a circuit board is supported on a flange of the frame. The circuit board has bosses which extend through apertures in the flange and contact the springs which are connected to L-shaped members in the base. An activation member extends through the circuit board and is positioned by a cap. A see-saw switch is connected to the activation member.

1 Claim, 6 Drawing Sheets

ROCKER SWITCH WITH LED INDICATORS

FIELD OF THE INVENTION

The present invention relates to a switch assembly for an LED illumination switch device and comprises less number of parts.

BACKGROUND OF THE INVENTION

A conventional LED switch assembly is shown in FIG. 1 and generally includes a base 1' with a top opening 12' and two recesses 11' defined in two sides of the base 1'. Two pairs of L-shaped members 121' are installed in the base 1' and two V-shaped members 122' are respectively located between the two pairs of L-shaped members 121. A frame 2' has two legs 22' which are snapped on the recesses 11' and an open top 21' for receiving a see-saw switch 4' engaged therein. A flange extends from an inside of the open top and has holes 211' for LED 3' extending therethrough. Each LED has wires 31' tangled on the L-shaped members 121'. The see-saw switch 4' has two extensions 41' which contact the V-shaped members 122' so that when pushes either end of the see-saw switch 4', one of the two LED lights up.

Another conventional LED switch assembly is shown in FIGS. 2 and 3 and generally includes a base 1" with a top opening 12" and two bosses 11" extending from two sides of the base 1". Two terminal members 121" and two springs 122" are installed in the base 1" and a contact plate 123" is located above the two terminal members 121". A frame 3" has two legs 33" which are engaged with the bosses 11" and an LED is engaged with a hole 32" in the frame 3". An activation member 2" has an open top 21" which extends through an aperture 31" in the frame 3" so as to be connected to a see-saw switch 6". Two extensions 22" on the activation member 2" contact the contact plate 123". The way that the wires of the LED connected to the two terminal members 121" is shown in FIG. 3.

These two conventional LED switch assemblies involve too many tiny parts and the it is a time-costly work to tangle the wires to the L-shaped members 121' or the terminal members 121". Besides, when the see-saw switch is pushed downward at the right end, the LED on the left end lights up, this often confuses the users.

SUMMARY OF THE INVENTION

In accordance with one aspect of the present invention, there is provided a switch assembly which comprises a base having two pairs of L-shaped members received therein and each of the L-shaped members has a spring connected thereon. Two V-shaped members are respectively located between the two pairs of L-shaped members. A frame is mounted on the base and has an open top. A flange extends from an inside of the open top and has four apertures defined therethrough. A circuit board is supported on the flange in the frame and two LEDs are connected on the circuit board. Four bosses extend from an underside of the circuit board and contact the spring via the apertures in the flange. A cap is engaged with the open top of the frame and two holes are defined through the cap so that the LEDs are engaged with the holes. An activation member extends through the circuit board and a shaft of the activation member extends through the cap. Two extensions of the activation member contact the V-shaped members. A see-saw switch is connected to the shaft of the activation member.

The primary object of the present invention is to provide a switch assembly that involves less number of parts and the assembling processes of the switch assembly is simplified.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
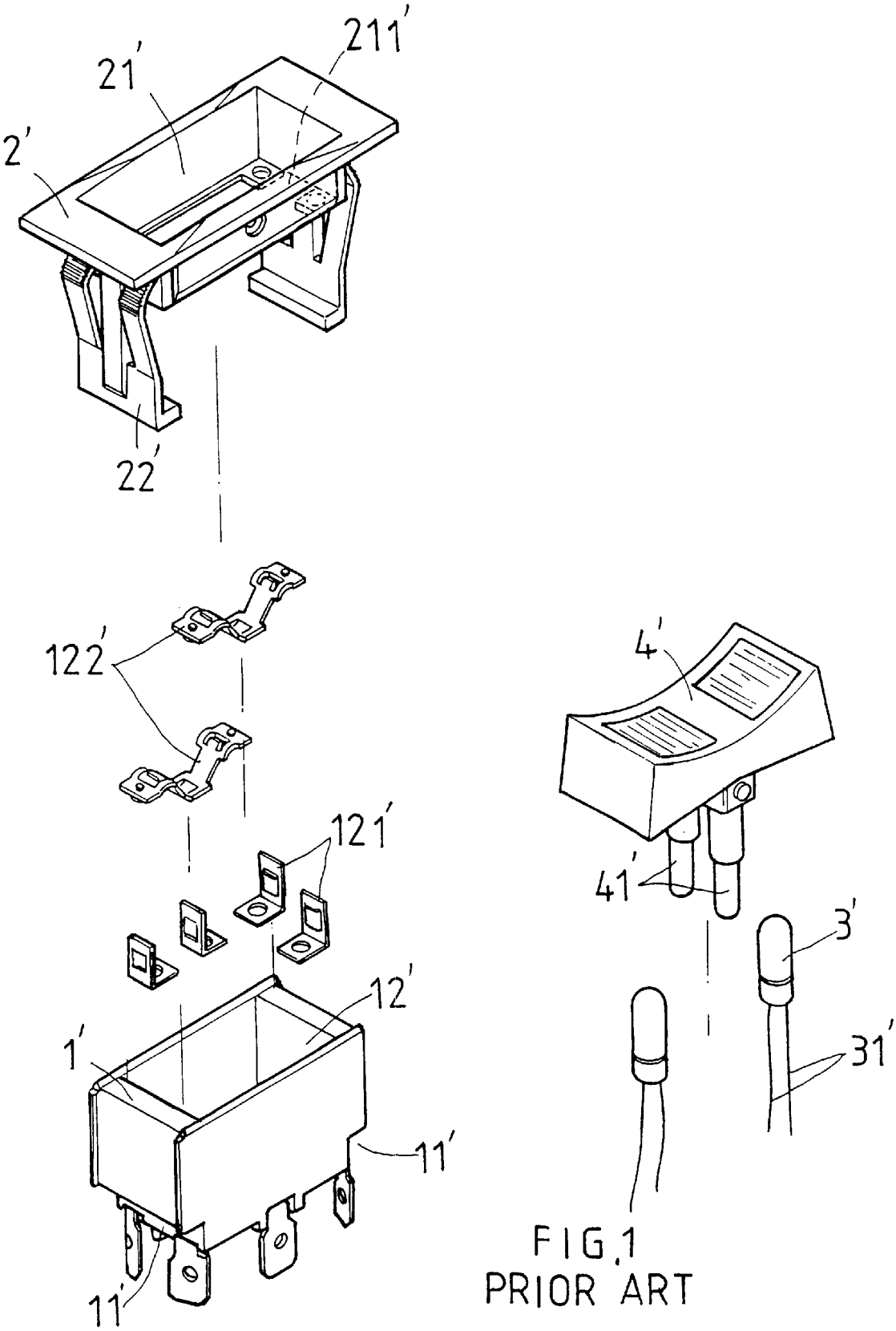
FIG.1 PRIOR ART
FIG. 1 is an exploded view to show a first conventional LED switch assembly.
Figure 2:
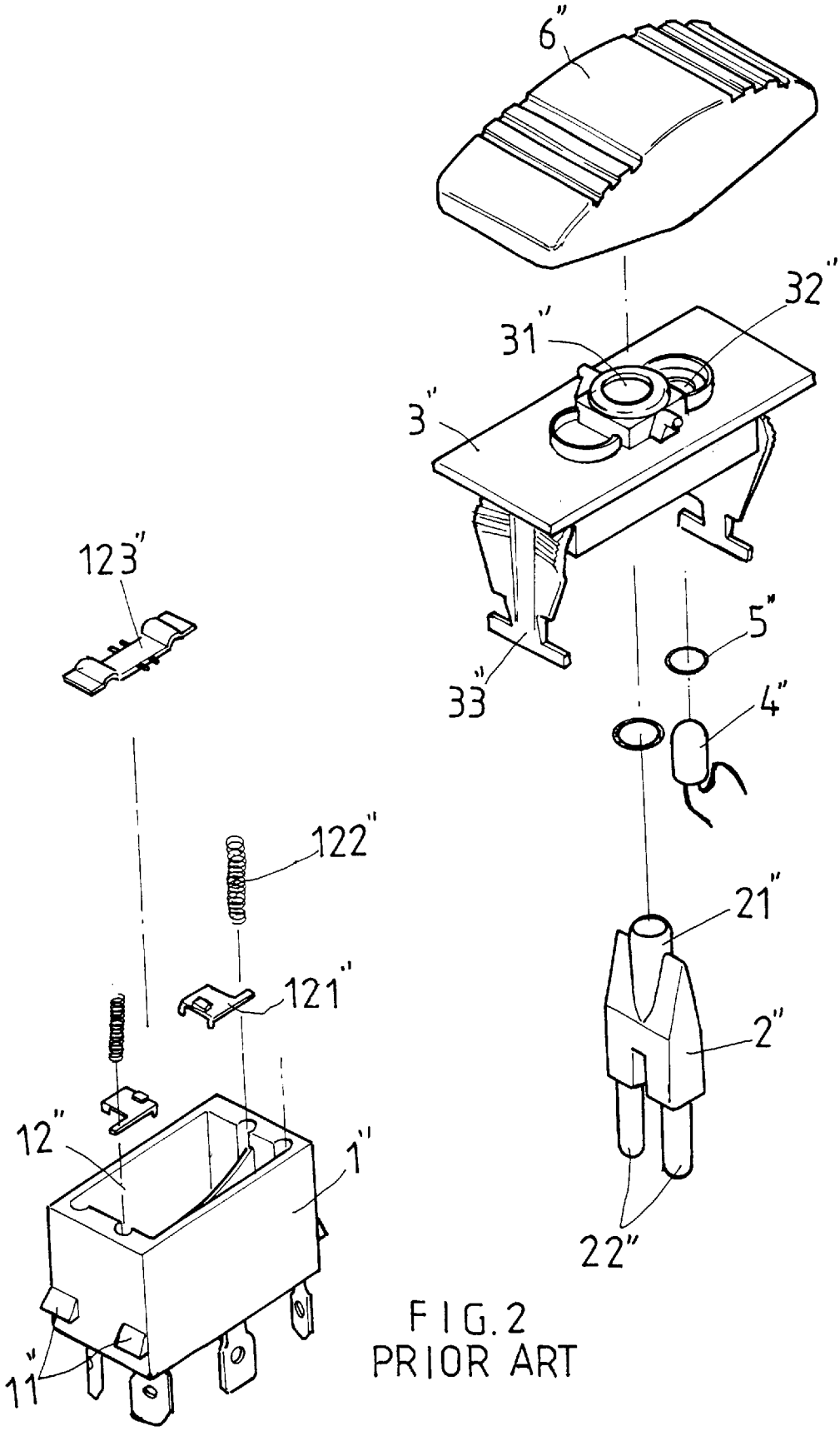
FIG. 2 PRIOR ART
FIG. 2 is an exploded view to show a second conventional LED switch assembly.
Figure 3:
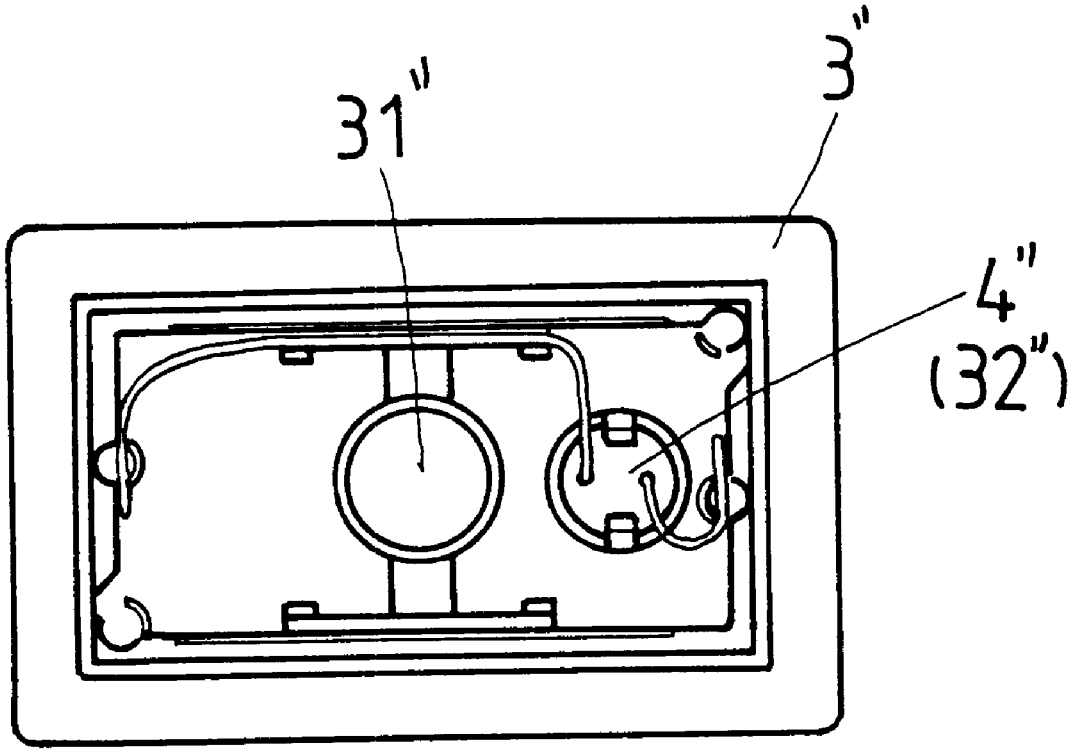
FIG. 3 PRIOR ART
FIG. 3 is a plan view to show the way that the wires of the LED connected to the two terminal members of the second conventional LED switch assembly.
Figure 4:
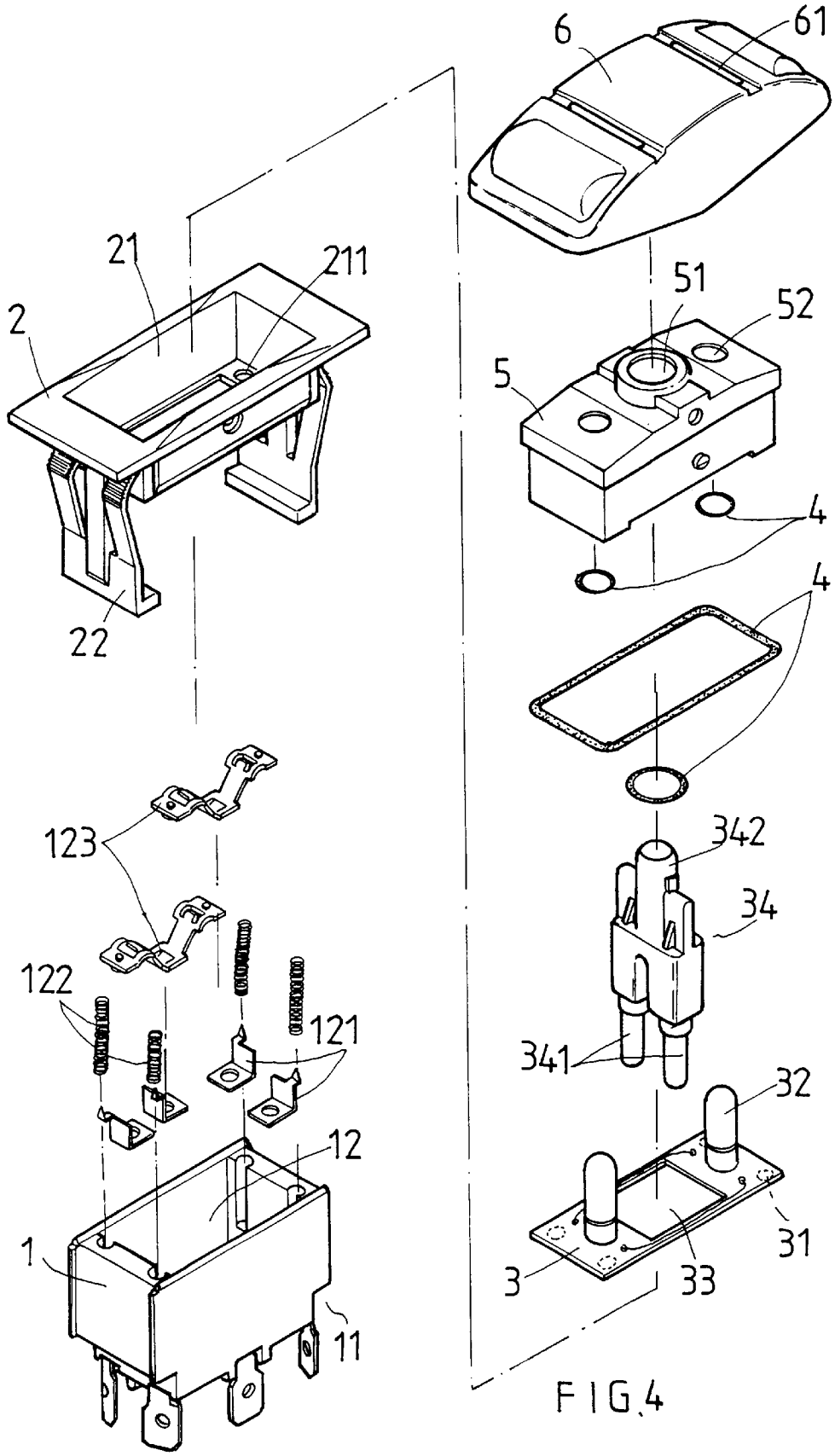
FIG. 4 is an exploded view to show the LED switch assembly of the present invention.
Figure 5:
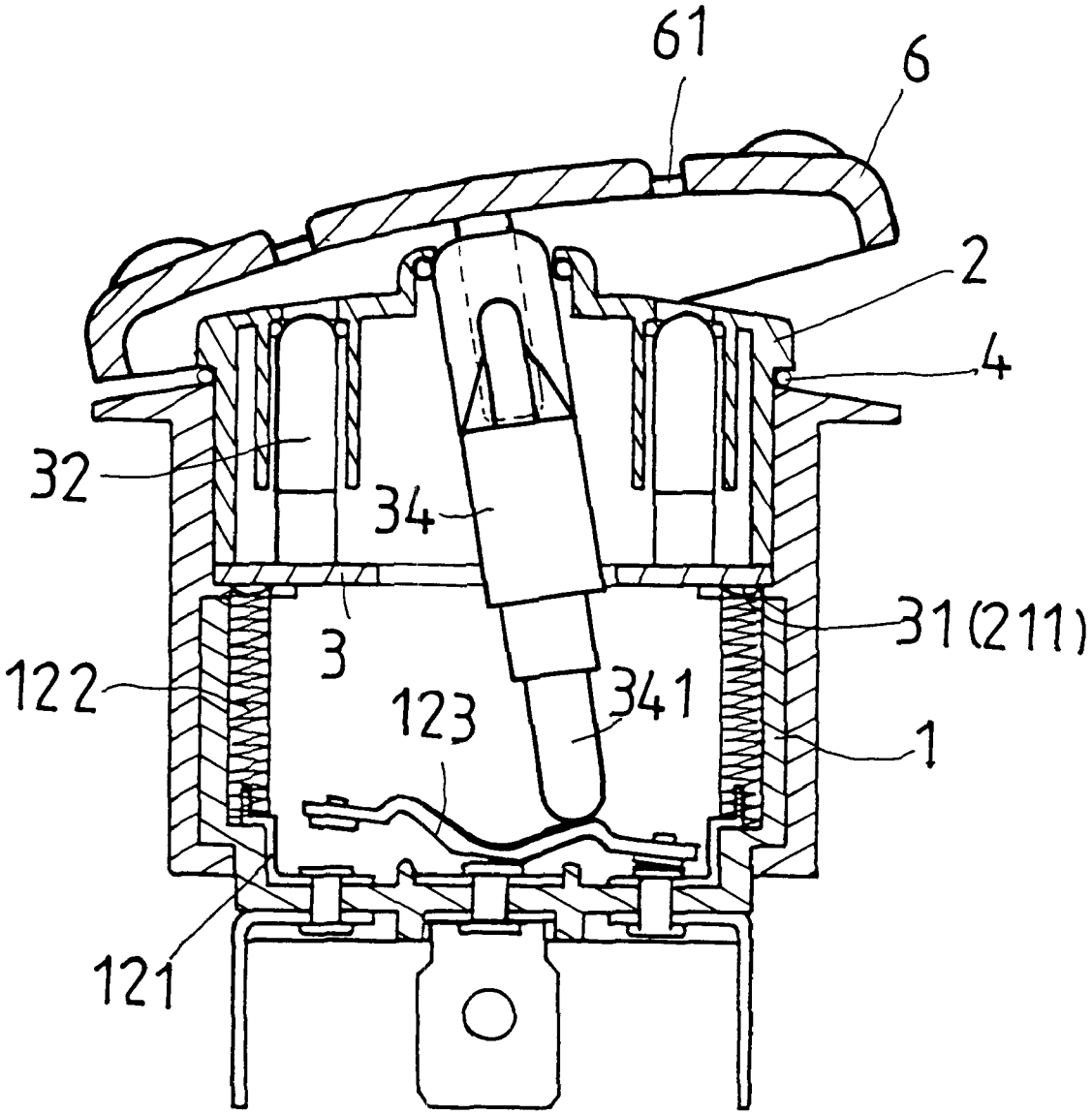
FIG. 5 is a cross sectional view to show the LED switch assembly of the present invention, wherein the see-saw switch is tilted at one end.

Referring to FIGS. 4 and 5, the switch assembly of the present invention comprises a base 1 having two recesses 11 defined in two sides thereof and two pairs of L-shaped members 121 are received in an open top 12. Each of the L-shaped members 121 has a spring 122 connected thereon. Two V-shaped members 123 are respectively located between the two pairs of L-shaped members 121.

A frame 2 has two legs 22 which are engaged with the two recesses 11 so that the frame 2 is mounted on the base 1. The frame 2 has an open top 21 and a flange extends from an inside of the open top 21. The flange has four apertures 211 defined therethrough.

A circuit board 3 is supported on the flange in the frame 2 and two LEDs 32 are connected on the circuit board 3. A rectangular hole 33 is defined through the circuit board 2 and four bosses 31 extend from an underside of the circuit board 3. The bosses 31 contact the springs 122 via the apertures 211 in the flange.

A cap 5 is engaged with the open top 21 of the frame 2 and two holes 52 are defined through the cap 5 so that the LEDs 32 are engaged with the holes 52. A central hole 51 is defined through the cap 5 and located between the two holes 52. An activation member 34 extends through the rectangular hole 33 of the circuit board 3 and a shaft 342 of the activation member 34 extends through the central hole 51 in the cap 5. Two extensions 341 of the activation member 34 contact the V-shaped members 123. Four seals 4 are engaged between the cap 5 and the circuit board 3, the holes 52 and the LEDs, and the shaft 342 and the central hole 51.

A see-saw switch 6 is connected to the shaft 342 of the activation member 34.

Figure 6:
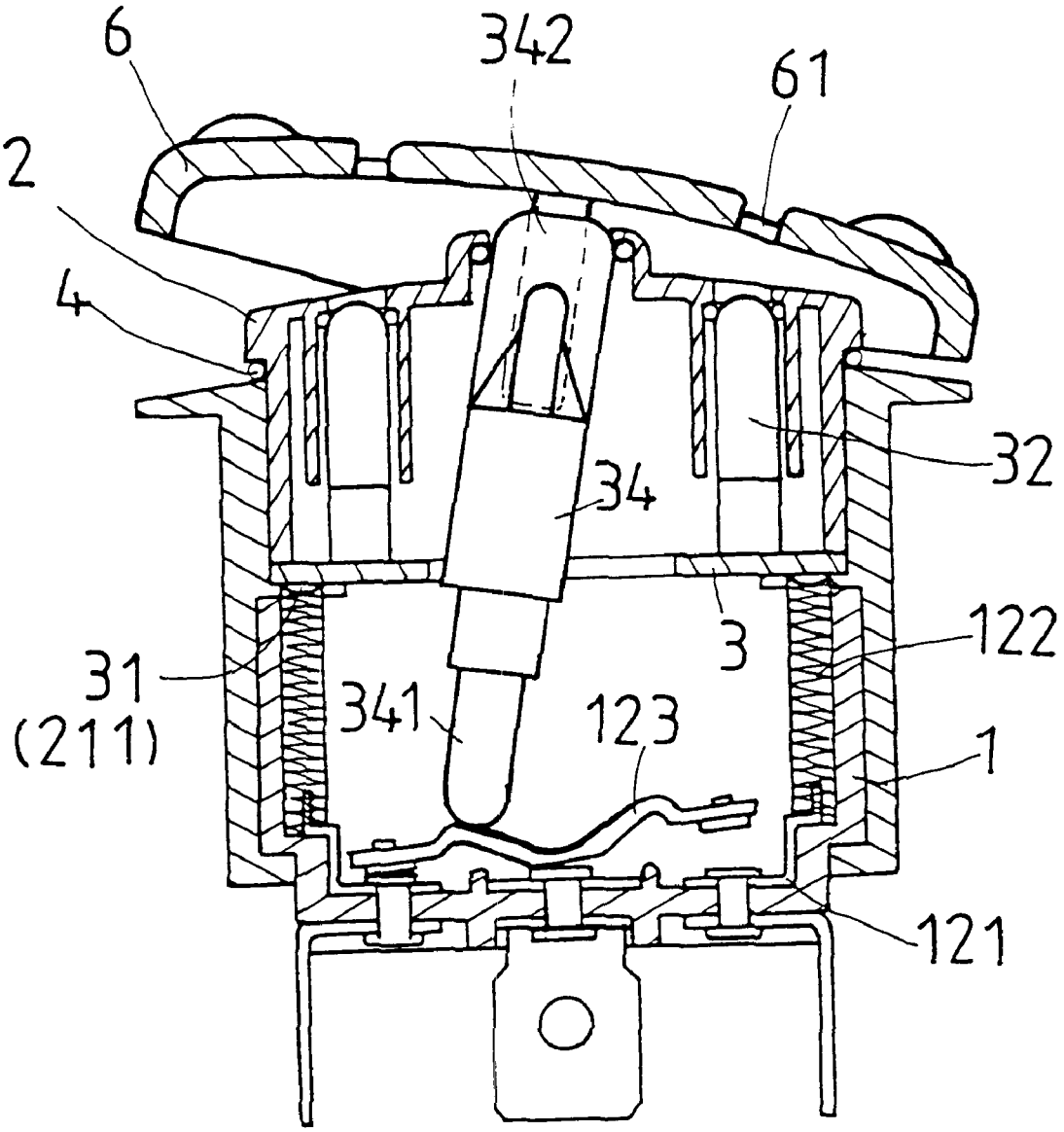
FIG. 6 is a cross sectional view to show the LED switch assembly of the present invention, wherein the see-saw switch is tilted at the other end.

By the circuits arrangement of circuit board 3, when the see-saw switch 6 is tilted at right end, the right side hand LED lights up as shown in FIG. 5. When the see-saw switch 6 is tilted at left end, the left side hand LED lights up as shown in FIG. 6. The see-saw switch 6 has two slits 61 so that the users can tell which LED lights up via the slits 61.

While we have shown and described the embodiment in accordance with the present invention, it should be clear to those skilled in the art that further embodiments may be made without departing from the scope of the present invention.

What is claimed is:

1. A rocker switch assembly comprising:

a base having two pairs of L-shaped members received therein and each of said L-shaped members having a spring connected thereon, two V-shaped members respectively located between said two pairs of L-shaped members;

a frame mounted on said base and having an open top, a flange extending from an inside of said open top and having four apertures defined therethrough;

a circuit board supported on said flange in said frame and at least two LEDs connected on said circuit board, a rectangular hole defined through said circuit board and four bosses extending from an underside of said circuit board, said bosses contacting said springs via said apertures in said flange;

a cap engaged with said open top of said frame and two holes defined through said cap so that said LEDs are engaged with said holes, a central hole defined through said cap and located between said two holes, said cap capturing said circuit board against said flange of said frame;

an activation member disposed in said frame to extend through said rectangular hole of said circuit board, a shaft of said activation member extending through said central hole in said cap, two extensions of said activation member contacting said V-shaped members; and a see-saw switch connected to said shaft of said activation member for actuating displacement thereof.

* * * * *